United States Patent [19]

Roos

[11] Patent Number: 5,009,829

[45] Date of Patent: Apr. 23, 1991

[54] PROCESS FOR MANUFACTURING YARNS BY MELTSPINNING POLYETHYLENE TEREPHTHALATE

[75] Inventor: Antonius Roos, Veenendaal, Netherlands

[73] Assignee: Akzo N.V., Arnhem, Netherlands

[21] Appl. No.: 372,763

[22] Filed: Jun. 29, 1989

Related U.S. Application Data

[63] Continuation-in-part of Ser. No. 169,222, Mar. 16, 1988, abandoned.

[30] Foreign Application Priority Data

Mar. 16, 1987 [NL] Netherlands ..... 8700617

[51] Int. Cl.[5] ..... D01F 6/62

[52] U.S. Cl. ..... 264/210.6; 264/210.8; 264/211; 264/211.14

[58] Field of Search ..... 525/10; 264/210.8, 211, 264/210.2, 210.6, 211.14

[56] References Cited

U.S. PATENT DOCUMENTS

| | | | |
|---|---|---|---|
| 3,452,132 | 6/1969 | Pitzl | 264/210.8 |
| 3,692,745 | 9/1972 | Molendar | 525/10 |
| 4,003,974 | 1/1977 | Chantry et al. | 264/210.8 |
| 4,113,704 | 9/1978 | MacLean | 264/210.8 |

FOREIGN PATENT DOCUMENTS

| | | |
|---|---|---|
| 0201114 | 12/1986 | European Pat. Off. . |
| 2102798 | 8/1971 | Fed. Rep. of Germany . |
| 8301253 | 4/1983 | World Int. Prop. O. . |

*Primary Examiner*—Hubert C. Lorin
*Attorney, Agent, or Firm*—Oliff & Berridge

[57] ABSTRACT

A single-step process by which HMLS industrial yarns may be manufactured, in which (a) the solid PETP has a relative viscosity (determined as described below) in the range of 1.8 to 2.1; (b) before spinning, the PETP is mixed with 0.1–0.8% by weight of a bis-(kenenimine); (c) the molten PETP is drawn off from the spinneret orifices at a speed in the range of 1500 to 4000 m/min; and (d) the spun product formed is drawn without intermediate winding at a draw ratio of 1.5 to 4.0, the draw ratio being selected such that the final speed of the yarn is not higher than 6000 m/min.

8 Claims, No Drawings

PROCESS FOR MANUFACTURING YARNS BY MELTSPINNING POLYETHYLENE TEREPHTHALATE

This is a continuation-in-part of application Ser. No. 07/169,222, filed Mar. 16, 1988, now abandoned.

TECHNICAL FIELD

The invention relates to the manufacture of industrial yarns by meltspinning polyethylene terephthalate (hereinafter "PETP"), in which process in one operation, solid PETP is melted and the molten PETP is extruded through spinning orifices and solidified into a spun product which is drawn into a yarn.

BACKGROUND OF THE INVENTION

The present invention relates to the manufacture of industrial yarn, for example, for reinforcement of rubber objects such as automobile tires. It is important that industrial yarns have good thermal dimensional stability, i.e., high modulus (HM) and low shrinkage (LS). For example, for use in the production of tire cords, industrial yarns must have a hot air shrinkage as low as possible, in no event as large as 3.4%. The same is true for production of conveyor belts and rubber hoses, in which similar low shrinkage is necessary to obtain satisfactory results in the modeling step. In order to improve driving comfort provided by tire cords formed of industrial fibers, the modulus should be greater than 30 cN/tex LASE (load at specified elongation) 5%. Accordingly, the industrial yarns manufactured according to the invention are referred to herein as HMLS yarns.

To enhance durability so as to resist severe application conditions encountered, e.g., by large conveyor belts and large tires, industrial yarns must have good fatigue resistance.

It is also necessary that industrial yarns for use in reinforcement (e.g., rubber reinforcement) applications have tenacity in excess of 60 cN/tex. Accordingly, industrial yarns are of linear densities of at least 1000 dtex (preferably at least 1300 dtex) so as to provide adequate breaking tenacity/yarn.

Another important property of industrial yarns is a low elongation at break in comparison to textile yarns.

The HMLS yarns manufactured according to the invention may be processed in a known way into reinforcing cord for automobile tires, and this cord may, in a way which is also known, be provided with a bonding agent, the so-called dip, so that a "dipped cord" is formed. HMLS yarns having said properties may be manufactured in a known way by spinning PETP at a speed of about 4000 m/min into an as-spun yarn of a high degree of orientation, which should thereafter be drawn at a ratio of about 2. This known method has the disadvantage that it cannot be carried out in a single step. For, in that case, the winding speed at the end of the process would have to be at least 6000 m/min. Such a winding speed of industrial yarn in large production units makes demands on the winding equipment which cannot be met, because there are no commercially available winding units capable of winding yarns of linear density greater than 1000 dtex at speeds above 6000 m/min. As a result, in actual practice, a two-step process is used, in which spinning and drawing of the filaments are conducted separately, raising the costs of production.

For a single-step process it would be desirable to provide a technique by which a lower spinning speed in the range of 1500 to 4000 m/min can be selected, whereafter the as-spun industrial yarn thus obtained can be drawn and wound in such a way as to result in a speed of not more than 6000 m/min. It appears that at the usual relative viscosity of the polymer of about 2, the as-spun yarn will display a preorientation which is too low and the desired HMLS properties are not obtained.

SUMMARY OF THE INVENTION

A single-step process has now been found by which HMLS yarns of the kind mentioned above may be manufactured under the following conditions:

(a) the solid PETP has a relative viscosity (determined as described below) in the range of 1.8 to 2.1;

(b) before spinning, the PETP is mixed with 0.1–0.8% by weight of a bis-(ketenimine) (hereinafter "BKI");

(c) the molten PETP is drawn off from the spinneret orifices at a spinning speed in the range of 1500 to 4000 m/min; and (d) the spun product formed is drawn without intermediate winding at a draw ratio of 1.5 to 4.0, the draw ratio being selected such that the final speed of the yarn is not higher than 6000 m/min.

DETAILED DESCRIPTION OF THE PREFERRED EMBODIMENTS

As discussed above, it is important that industrial fibers have good thermal dimensional stability. The thermal dimensional stability can be improved by using a low intrinsic viscosity (less than 0.8). This method has a drawback in that the tenacity of the cord and the fatigue resistance are deteriorated in return for improvement of the dimensional stability. Therefore, this kind of fiber is not suited for, e.g., tire reinforcement. It is preferable to use a relative viscosity of greater than 1.8, preferably greater than 1.9 (respectively corresponding to an intrinsic viscosity of greater than 0.8, or preferably greater than 0.9) in order to produce fibers of high tenacity (greater than 60 cN/tex) and good fatigue properties. When using the higher viscosities (in the range of 1.8 to 2.1), the spinneret or the spinning assembly are preferably heated.

The dimensional stability can also be improved significantly by melt spinning filaments and uniformly quenching the filaments under relatively high stress conditions to yield as-spun filaments with high orientation (measured by birefringence) of greater than 0.025. These high stress conditions can be made by meltspinning the filaments at high speeds (greater than 2500 m/min).

In order to make a yarn with high tenacity (greater than 60 cN/tex), which is valuable for industrial applications, it is necessary to stretch (draw) the yarn as far as possible. The draw ratio is limited by the appearance of fluffs. When the number of fluffs is too high, processing the fibers presents technical problems. A typical draw ratio for a yarn spun at 3000 m/min is 2.3 to produce a yarn with an elongation at break between 9% and 18%. In an integrated process, this would require a winding speed of $3000 \times 2.3 = 6900$ m/min. As discussed above, such a winding speed is not possible for the commercial production of industrial yarns.

To achieve an integrated process, it is necessary to select a lower spinning speed or to reduce the draw ratio (without reducing the tenacity), in such a way that the final winding speed is below 6000 m/min.

It has been found that by using BKI in combination with a relatively high spinning speed and a high viscosity, a yarn can be made with high tenacity, good fatigue resistance, good chemical stability and high dimensional stability in an integrated process at a final winding speed below 6000 m/min. The process according to the present invention provides a higher spin-line stress and therefore a higher orientation (birefringence) at the same spinning speed. High orientation makes it possible to use a lower draw ratio while achieving similar elongation at break properties.

The addition of BKI to PETP before spinning is known in itself from U.S. Pat. No. 3,692,745. In this known process, BKI is added to the PETP to reduce the carboxyl group concentration thereof, which results in a higher chemical stability. No mention is made at all in that patent of the above spinning conditions (c) and (d), and even less does it show that upon using a combination of the steps (a) through (d) an HMLS yarn may be obtained. The addition of BKI to the polymer may be carried out in the ways described in said U.S. patent, for instance by rolling PETP chips with the BKI in the form of powder. Alternatively, the BKI may be added to pre-melted polymer. The preferred BKI is the N,N'-bis(diphenyl vinylene) p-phenylene diamine, as it is fairly easy to prepare and gives good results. Other types of BKI which may be used are N,N'-bis(diphenyl vinylene)-4,4'-diphenylmethane diamine and N,N'-bis(-diphenyl- vinylene)-hexamethylene diamine.

The speed at which the spun product is drawn off from the spinneret is in the range of 1500 to 4000 m/min, depending on the relative viscosity and the desired properties of the end product. At low drawing off speeds it will be possible in the last step to use a somewhat higher draw ratio (e.g. approaching 4.0) than at higher drawing off speeds.

The yarns obtained according to the invention generally have the aforementioned HMLS properties. They also exhibit better thermal and chemical stability than yarns with HMLS properties which are spun in the absence of BKI. The high spinning speed which is generally used for HMLS yarn will result in an open structure which is likely to be chemically attacked and is sensitive to high temperatures. This drawback is reduced by the addition of BKI.

The parameters such as titre (linear density), modulus, tenacity, 5% LASE (Load AT Specified Elongation), elongation at break and "hot air shrinkage" at 180° C. are determined in accordance with ASTM D885-M-1979. Contrary to the procedure used in said standard method, the hot air shrinkage, referred to here also as HAS, is measured at 180° C. and at a pre-tension of 1 cN/tex. Relative viscosity is determined by dissolving 1 g of PETP with heating in 100 g of metacresol. The flow time $t_s$ at 25° C. of the resulting solution is measured using a capillary with an internal diameter of 1.25 mm. Under the same conditions, the flow time $t_0$ is measured of the metacresol in which no PETP has been dissolved. The relative viscosity is the ratio of $t_1$ to $t_0$.

Dipped cord made from yarns manufactured according to the present invention has hot air shrinkage values in the range of from about 3.5 to 1.5%.

EXAMPLES

PETP chips having relative viscosities as given in the table below are dusted with the given amounts of N,N'-bis(diphenyl vinylene) p-phenylene diamine.

Next, they are melted at a temperature of about 290° C. and extruded through a heated spinneret plate having 140 orifices of a diameter of 400 μm. Upon leaving the spinneret plate, the filaments are drawn off at a speed of $V_1$, as given in the table. They are cooled by air at room temperature. The formed filaments are passed over godets and successively drawn by winding at the speed $V_2$ given in the table. The filaments have the yarn properties listed in the table.

The resulting yarn is made into a tire cord of dtex 1100 (Z472) x 2 (S472). Next, the greige cords are dipped in two steps to improve the adhesion to elastomeric materials. The properties of the dipped cords are listed in the table. The two-step dipping of the cord according to the invention is carried out in the following manner known per se. In a continuous process the cord is passed through a first bath for the application of a preliminary dip, and then through a second bath for the application of the main dip. Between the first and the second baths, the cord is dried for 60 seconds at a temperature of 240° C. and at a tension of 10N. After the application of the main dip, i.e., after leaving the second bath, the cord is once again dried for 120 seconds at 220° C. and at a tension of 4.5N.

The dip compositions are the same as those described in the example of European Patent Application No. EP 201,114.

TABLE

| | Experiment 1 | Example 2 | Experiment 3 | Example 4 |
|---|---|---|---|---|
| Percentage by weight of BKI | — | 0.3 | — | 0.3 |
| Temp. spinneret plate (°C.) | 303 | 303 | 299 | 299 |
| $V_1$ (m/min) | 1500 | 1500 | 3000 | 3000 |
| Rel. viscosity spun product | 1.86 | 2.00 | 1.90 | 1.99 |
| $V_2$ (m/min) | 5700 | 4800 | 6900 | 5970 |
| yarn properties | | | | |
| titre (dtex) | 1040 | 1064 | 1094 | 1040 |
| tenacity (cN/tex) | 79.7 | 76.9 | 74.2 | 72.7 |
| a elongation a break | 9.5 | 10.0 | 10.2 | 10.1 |
| dipped cord properties | | | | |
| titre (dtex) | 2402 | 2430 | 2484 | 2434 |
| tenacity (cN/tex) | 58.8 | 55.7 | 56.7 | 52.3 |
| elongation at rupture | 12.2 | 11.6 | 13.0 | 11.4 |
| LASE 5% (cN/tex) | 21.2 | 20.9 | 20.0 | 20.5 |
| HAS at 180° C. (%) | 3.7 | 3.1 | 2.9 | 2.5 |

In Experiments 1 and 3, which are not according to the invention, no BKI is used.

In Experiment 1, use is made in a single-step process of the speeds $V_1$ and $V_2$ which are still applicable in commercial scale production. Although the properties are correct in all other respects, the hot air shrinkage of the dipped cord (HAS) is too high, namely 3.7%.

In Experiment 3, without the addition of BKI, the product obtained is excellent, but the winding speed is 6900 m/min. This speed may be used for a limited period of time using laboratory equipment, but not on a large scale and in a commercially acceptable way.

According to Examples 2 and 4, yarns are obtained which have properties comparable to those according to Comparative Experiment 1. The favorable effect of the method according to the invention manifests itself with the dipped cord. The hot air shrinkage (HAS) of the cord in Examples 2 and 4 is considerably lower than in Experiment 1. Such a favorable value is also obtained in Experiment 3 but, as has been said before, an undesirably (i.e., not realizable yet in actual practice) high $V_2$ is used there. Furthermore, the favorable HAS value of Example 4 surpasses that of Experiment 3.

I claim:

1. A process for manufacturing industrial yarns by melt-spinning polyethylene terephthalate (PETP), comprising, in one operation, melting solid PETP, extruding the molten PETP through spinning orifices and solidifying the extruded PETP into a spun product which is drawn into a yarn, wherein:

(a) the solid PETP has a relative viscosity in the range of 1.8 to 2.1;

(b) before extruding, the PETP is mixed with 0.1–0.8% by weight of a bis-(ketenimine);

(c) the molten PETP is drawn off from the spinning orifices at a speed in the range of 1500 to 4000 m/min; and (d) the spun product formed is drawn without intermediate winding at a draw ratio of 1.5 to 4.0, the draw ration being selected such that the final speed of the yarn is not higher than 6000 m/min;

thereby producing industrial yarn at a speed not higher than 6000 m/min having an elongation at break of from about 9% to about 18%.

2. A process according to claim 1, wherein the bis(-ketenimine) is N,N'-bis(diphenyl vinylene) p-phenylene diamine.

3. A process according to claim 1, wherein the bis(-ketenimine) is N,N'-bis(diphenyl vinylene)-4,4'-diphenylmethane diamine or N,N'-bis(diphenyl vinylene)-hexamethylene diamine.

4. A process according to claim 1, wherein the linear density of the yarn is greater than 1000 dtex.

5. A process according to claim 1, wherein the linear density of the yarn is greater than 1300 dtex.

6. A process according to claim 1, wherein the tenacity of the yarn is greater than 60 cN/tex.

7. A process according to claim 1, wherein the modulus of the yarn is greater than 30 cN/tex (LASE 5%) and the hot air shrinkage of the yarn is less than 3.4%.

8. A process for manufacturing industrial yarns, comprising:

melting solid polyethylene terephthalate (PETP), the solid PETP having a relative viscosity in the range of from 1.8 to 2.1;

mixing the molten PETP with 0.1–0.8% by weight of a bis-(ketenimine);

extruding the mixture of molten PETP and bis-(ketenimine) through spinning orifices at a speed in the range of from 1500 to 4000 m/min;

solidifying the extruded PETP into a spun product;

drawing the spun product at a draw ration of from 1.5 to 4.0 without intermediate winding, the draw ratio being selected such that the final speed of the yarn is not higher than 6000 m/min; and winding the drawn yarn at a speed not higher than 6000 m/min;

thereby producing industrial yarn having an elongation at break of from about 9% to about 18%.

* * * * *

UNITED STATES PATENT AND TRADEMARK OFFICE

CERTIFICATE OF CORRECTION

PATENT NO. : 5,009,829

DATED : April 23, 1991

INVENTOR(S) : Antonius ROOS

It is certified that error appears in the above-identified patent and that said Letters Patent is hereby corrected as shown below:

On the title page, under item [57], line 5, change "bis-(kenenimine);" to --bis-(ketenimine);--.

Col. 4, line 47 (in the TABLE), change "a elongation a" to --elongation at--;

line 50 (in the TABLE), after "rupture" insert --(%)--.

Col. 6, line 25 (claim 8), change "ration" to --ratio--.

Signed and Sealed this

Sixth Day of October, 1992

*Attest:*

*Attesting Officer*

DOUGLAS B. COMER

*Acting Commissioner of Patents and Trademarks*